US008052341B2

(12) United States Patent
Huang

(10) Patent No.: US 8,052,341 B2
(45) Date of Patent: Nov. 8, 2011

(54) INTERLOCKED ROLL TYPE APPARATUS

(75) Inventor: Chun-Chia Huang, Taipei County (TW)

(73) Assignee: HiTi Digital, Inc., Taipei (TW)

( * ) Notice: Subject to any disclaimer, the term of this patent is extended or adjusted under 35 U.S.C. 154(b) by 428 days.

(21) Appl. No.: 12/464,074

(22) Filed: May 11, 2009

(65) Prior Publication Data

US 2010/0202815 A1 Aug. 12, 2010

(30) Foreign Application Priority Data

Feb. 12, 2009 (TW) ..... 98202012 U

(51) Int. Cl.
*B65H 75/00* (2006.01)

(52) U.S. Cl. ..... 400/242

(58) Field of Classification Search ..... 400/242, 400/30, 59, 186, 235.1, 330.8, 370, 388, 400/417, 508, 541, 594, 629, 636
See application file for complete search history.

(56) References Cited

U.S. PATENT DOCUMENTS 4,407,597 A * 10/1983 Kapp ..... 400/625
4,976,558 A * 12/1990 Kuzuya et al. ..... 400/615.2
5,238,198 A * 8/1993 Jingu et al. ..... 242/532.7
5,584,589 A * 12/1996 Adkins et al. ..... 400/584
6,422,772 B1 * 7/2002 Fisher et al. ..... 400/629
7,322,761 B2 * 1/2008 Silverbrook et al. ..... 400/614

* cited by examiner

*Primary Examiner* — Seung Lee
(74) *Attorney, Agent, or Firm* — Winston Hsu; Scott Margo

(57) ABSTRACT

An interlocked roll type apparatus comprises: a first spool, two first flanges, a second spool, and two second flanges. The first flange has a first surface, a second surface, and a first periphery surface. The first surface has a first round protruding part. The first periphery surface has at least a first arc part, and the first arc part has a first arc protruding part protruding from the first surface. The second flange has a third surface, a fourth surface, and a second periphery surface. The second periphery surface has at least a second arc part having a second arc protruding part protruding from the third surface. The second arc part and the second arc protruding part are fastened with the first round protruding part of the first flange. The fourth surface has a second arc trench part for fastened with the first arc protruding part of the first flange.

9 Claims, 9 Drawing Sheets

INTERLOCKED ROLL TYPE APPARATUS

BACKGROUND OF THE INVENTION

1. Field of the Invention

The present invention relates to an interlocked roll type apparatus, and more particularly, to an interlocked roll type apparatus which can be applied to a non-cassette package of ribbon of thermal dye-sublimation photo printer, and has advantages of low cost, small volume, convenient to carry, and capable of avoiding rolling.

2. Description of the Prior Art

In general, there are two kinds of packages for ribbon of thermal dye-sublimation photo printer: cassette package and non-cassette package. The cassette package has a larger volume and higher cost. However, conventional non-cassette package has disadvantages of hard to fasten the ribbon and not able to avoid ribbon loaded spool from rolling.

SUMMARY OF THE INVENTION

It is therefore one of the objectives of the present invention to provide an interlocked roll type apparatus which can be applied to a non-cassette package of ribbon of thermal dye-sublimation photo printer, and has advantages of low cost, small volume, convenient to carry, and capable of avoiding rolling.

In accordance with an embodiment of the present invention, an interlocked roll type apparatus is disclosed. The interlocked roll type apparatus comprises: a first spool, two first flanges, a second spool, and two second flanges. The first spool is utilized for providing a printing medium. The two first flanges respectively have a first surface, a second surface, and a first periphery surface. The first surface has a first round protruding part. The first periphery surface has at least a first arc part, and the first arc part has a first arc protruding part protruding from the first surface. The two first flanges are respectively disposed on two sides of the first spool, and the first spool is connected to center of the second surface of the two first flanges. The second spool is utilized for loading the printing medium, wherein a length of the second spool is longer than that of the first spool. The two second flanges are respectively corresponding to the first two flanges and have a third surface, a fourth surface, and a second periphery surface. The second periphery surface has at least a second arc part, and the second arc part has a second arc protruding part protruding from the third surface. The second arc part and the second arc protruding part are fastened with the first round protruding part of the first flange. The fourth surface has a second arc trench part for fastened with the first arc protruding part of the first flange. The two second flanges are respectively disposed on two sides of the second spool, and the second spool is connected to center of the fourth surface of the two second flanges.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. This document does not intend to distinguish between components that differ in name but not function. In the following discussion and in the claims, the terms "include", "including", "comprise", and "comprising" are used in an open-ended fashion, and thus should be interpreted to mean "including, but not limited to . . . ".

Figure 1:
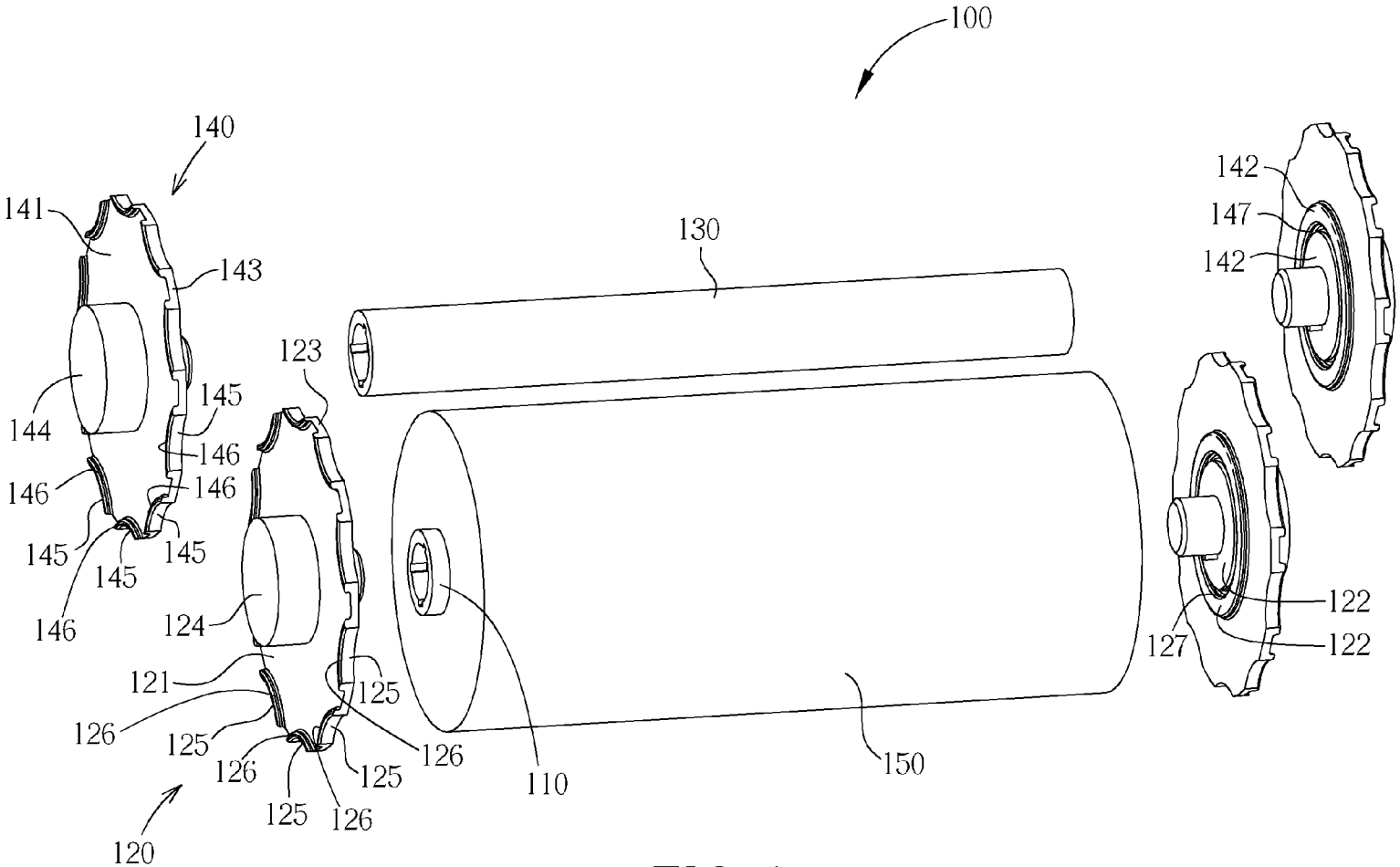
FIG. 1 is an exploded diagram illustrating an interlocked roll type apparatus according to an embodiment of the present invention.

Please refer to FIG. 1. FIG. 1 is an exploded diagram illustrating an interlocked roll type apparatus 100 according to an embodiment of the present invention. As shown in FIG. 1, the interlocked roll type apparatus 100 comprises: a first spool 110, two first flanges 120, a second spool 130, and two second flanges 140. The first spool 110 is utilized for providing a printing medium 150 (such as a ribbon). The two first flanges 120 respectively have a first surface 121, a second surface 122, and a first periphery surface 123. The first surface 121 has a first round protruding part 124. The first periphery surface 123 has ten first arc parts 125, and there is a predetermined interval between the ten first arc parts 125, wherein each first arc part 125 has a first arc protruding part 126 protruding from the first surface 121. The two first flanges 120 are respectively disposed on two sides of the first spool 110, and the first spool 110 is connected to center of the second surface 122 of the two first flanges 120. In addition, the second surface 122 of each first flange 120 has a first ring type trench part 127.

The second spool 130 is utilized for loading the printing medium 150, wherein a length of the second spool 130 is longer than that of the first spool 110. The two second flanges 140 are respectively corresponding to the first two flanges 120 and have a third surface 141, a fourth surface 142, and a second periphery surface 143, wherein the third surface 141 of each second flange 140 has a second round protruding part 144. The second periphery surface 143 has ten second arc parts 145, and each second arc part 145 has a second arc protruding part 146 protruding from the third surface 141. Any second arc part 145 and the second arc protruding part 146 thereof can be utilized for fastening with the first round protruding part 124 on the first surface 121 of the first flange 120. The fourth surface 142 has a second ring type trench part 147 for fastened with any one of the first arc protruding part 126 on the first surface 121 of the first flange 120. The two second flanges 140 are respectively disposed on two sides of the second spool 130, and the second spool 130 is connected to center of the fourth surface 142 of the two second flanges 140. Please note that when the first flanges 120 and the second flanges 140 are designed to be the same flanges, the first flanges 120 and the second flanges 140 can be formed by a same mold to reduce production cost.

Figure 2:
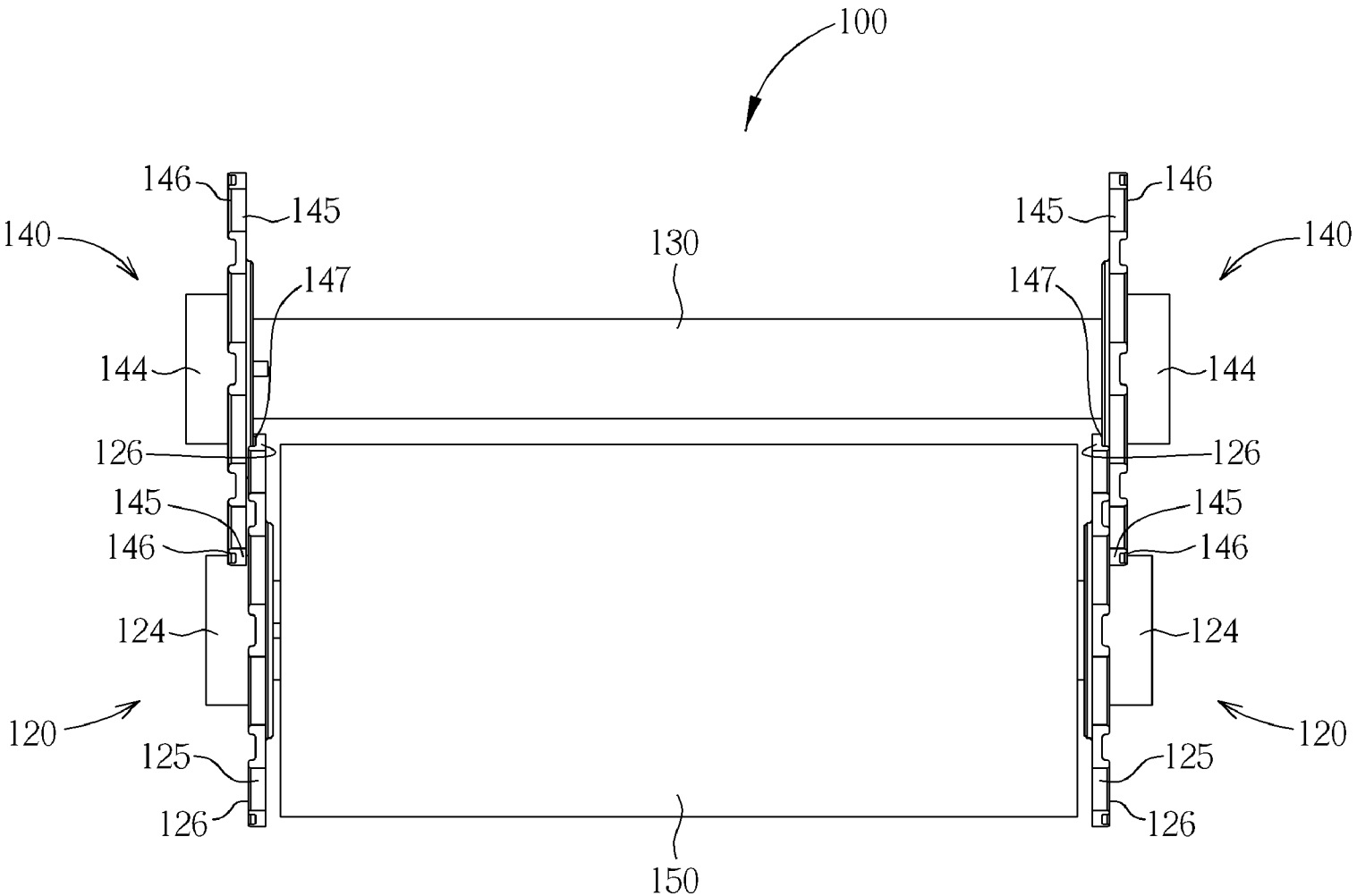
FIG. 2 is a plane diagram illustrating the interlocked roll type apparatus after assembled.
Figure 3:
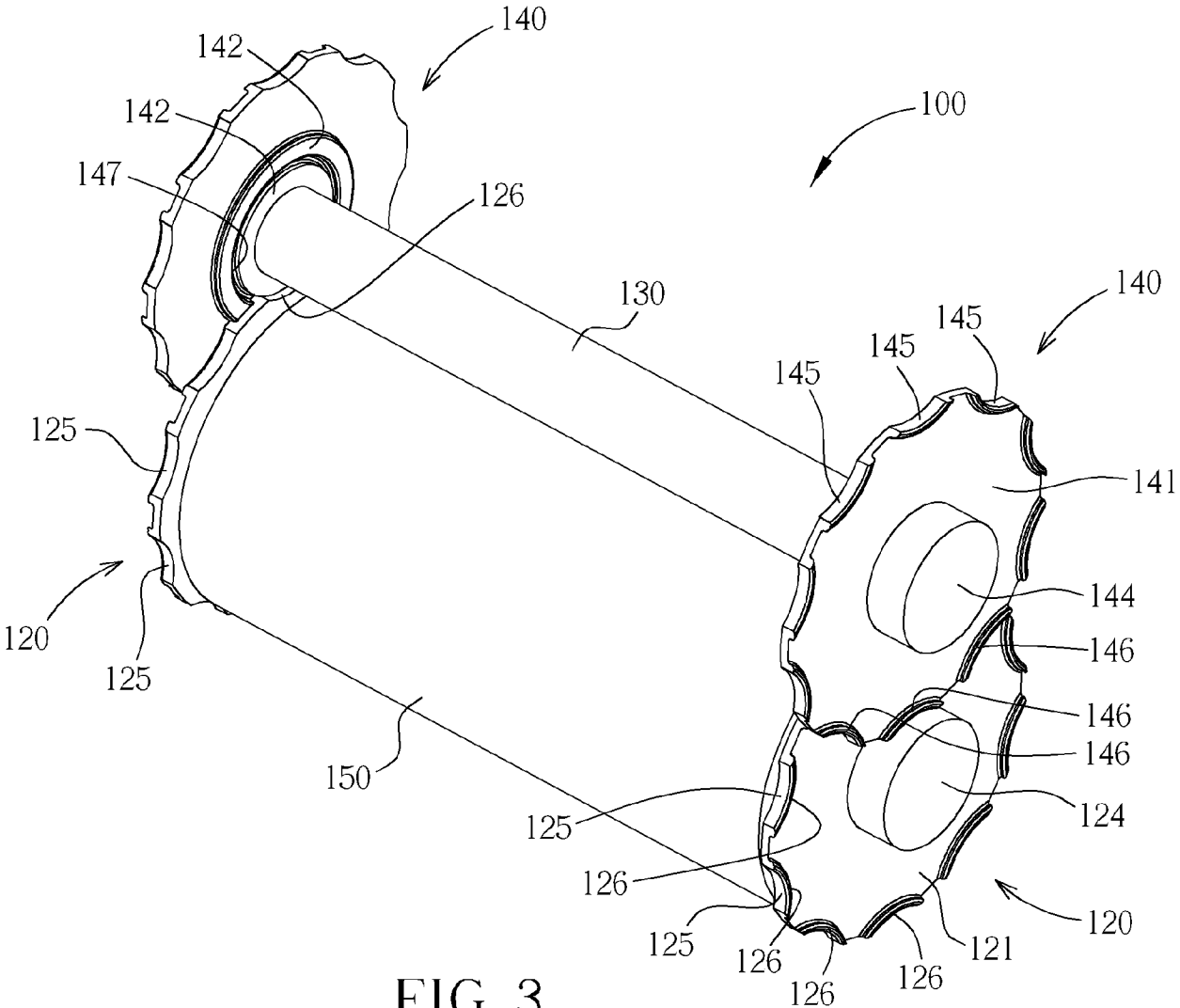
FIG. 3 is a three-dimensional diagram illustrating the interlocked roll type apparatus after assembled.
Figure 4:
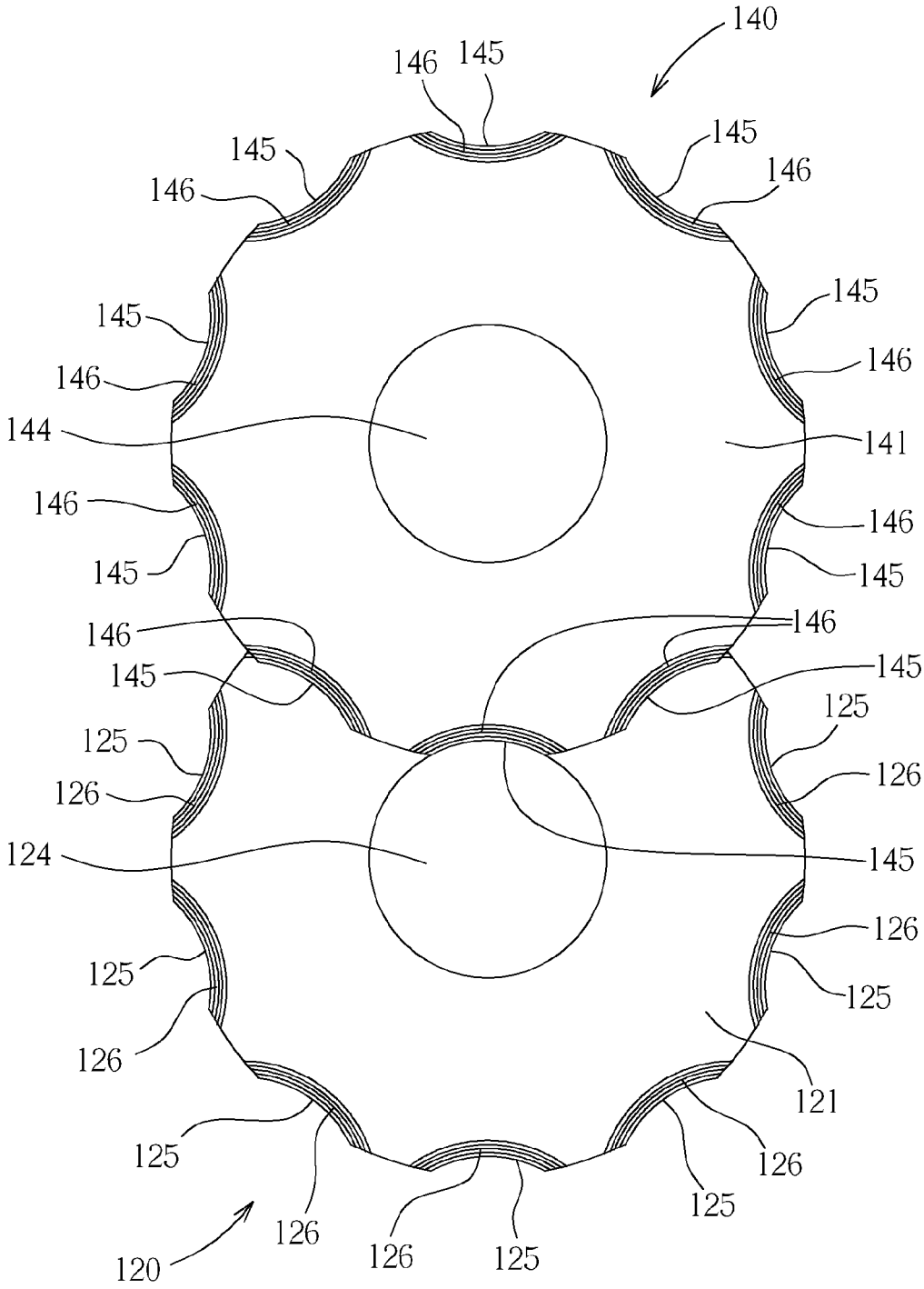
FIG. 4 is a side view diagram illustrating the first flange fastened with the second flange in the interlocked roll type apparatus shown in FIG. 2 and FIG. 3.
Figure 5:
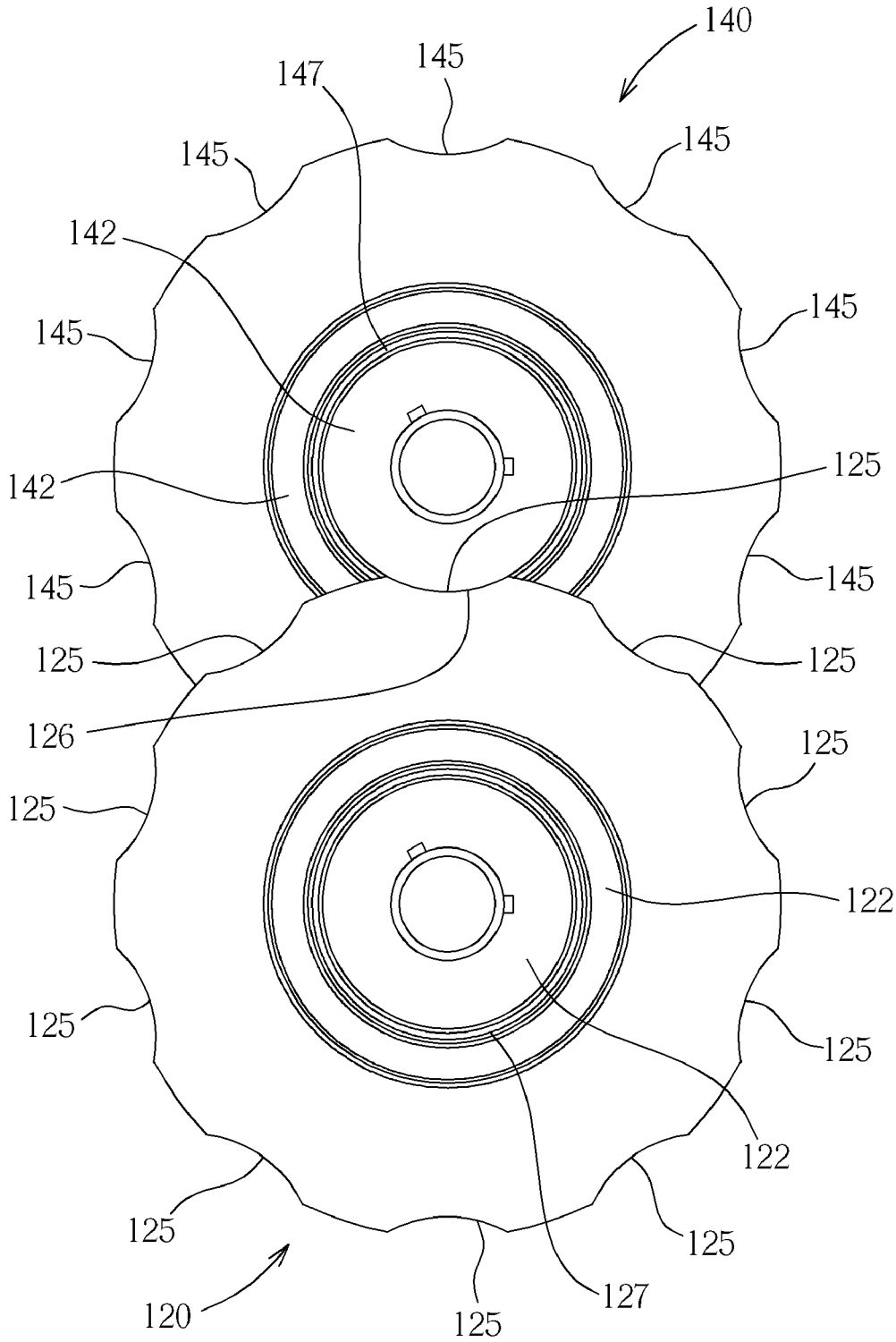
FIG. 5 is another side view diagram illustrating the first flange fastened with the second flange in the interlocked roll type apparatus shown in FIG. 2 and FIG. 3.
Figure 6:
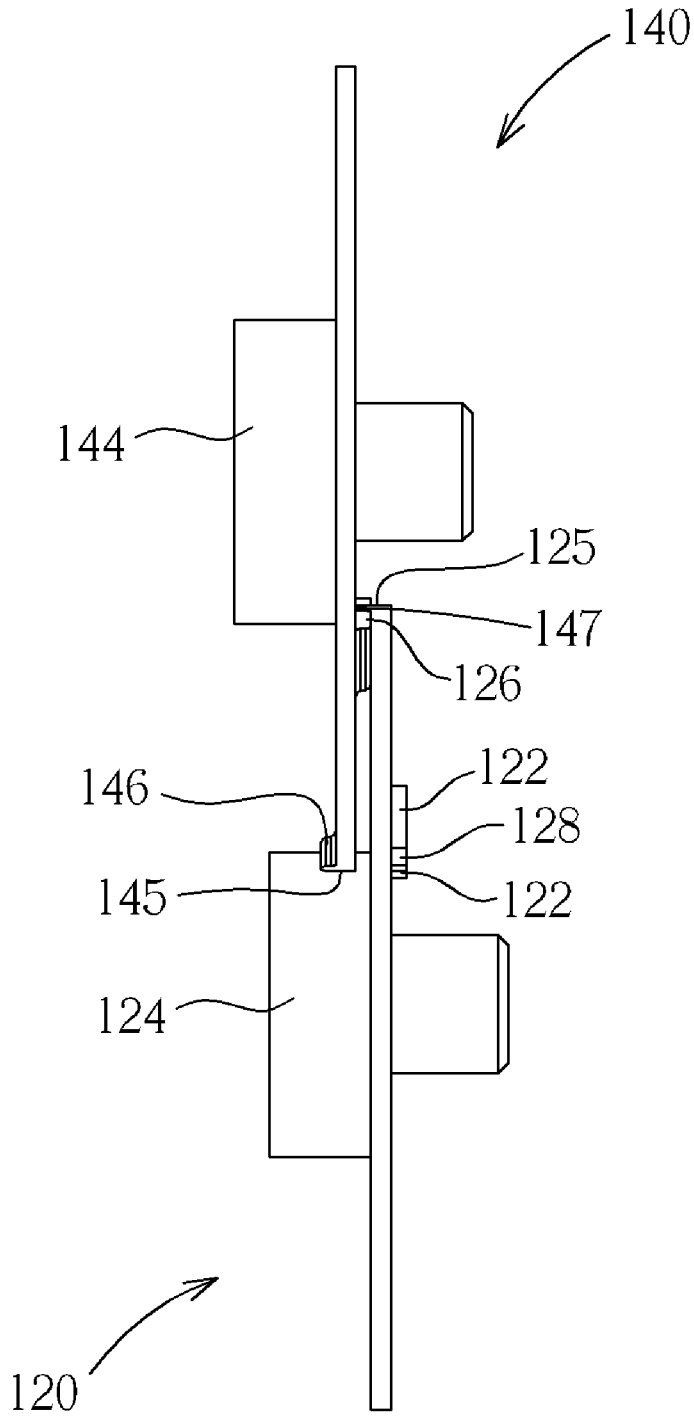
FIG. 6 is a plane diagram illustrating the first flange and the second flange according to another embodiment of the present invention.

Please refer to FIG. 2, FIG. 3, FIG. 4, and FIG. 5. FIG. 2 is a plane diagram illustrating the interlocked roll type apparatus 100 after assembled. FIG. 3 is a three-dimensional diagram illustrating the interlocked roll type apparatus 100 after assembled. FIG. 4 is a side view diagram illustrating the first flange 120 fastened with the second flange 140 in the interlocked roll type apparatus 100 shown in FIG. 2 and FIG. 3. FIG. 5 is another side view diagram illustrating the first flange 120 fastened with the second flange 140 in the interlocked roll type apparatus 100 shown in FIG. 2 and FIG. 3. As shown in FIG. 2, FIG. 3, and FIG. 4, a specific second arc part 145 and the second arc protruding part 146 thereof on the third surface 141 of the second flange 140 can be utilized for fastening with the first round protruding part 124 on the first surface 121 of the first flange 120. In addition, as shown in FIG. 2, FIG. 3, and FIG. 5, the second ring type trench part 147 on the fourth surface 142 of the second flange 140 is fastened with a specific first arc protruding part 126 on the first surface 121 of the first flange 120. In this way, when the interlocked roll type apparatus 100 of the present invention is applied to a non-cassette package of ribbon of thermal dye-sublimation photo printer, the package volume can be minimized, and the interlocked roll type apparatus 100 has an advantage of convenient to carry. In addition, since there are a plurality of first arc parts 125 on the first periphery surface 123 of the first flange 120 and there are a plurality of second arc parts 145 on the second periphery surface 143 of the second flange 140, when the first spool 110 and the second spool 130 of the interlocked roll type apparatus 100 are separated from each other (i.e. the first flange 120 and the second flange 140 are released from self-locked status), the interlocked roll type apparatus 100 has an advantage of avoiding rolling.

Please note that the above embodiment is only for an illustrative purpose and is not meant to be a limitation of the present invention. For example, the number of the first arc part 125 and the first arc protruding part 126 on the first flange 120 and the number of the second arc part 145 and the second arc protruding part 146 on the second flange 140 can be changed according to different design requirement. The first ring type trench part 127 can be changed to an arc trench part, and the second ring type trench part 147 also can be changed to an arc trench part.

Figure 7:
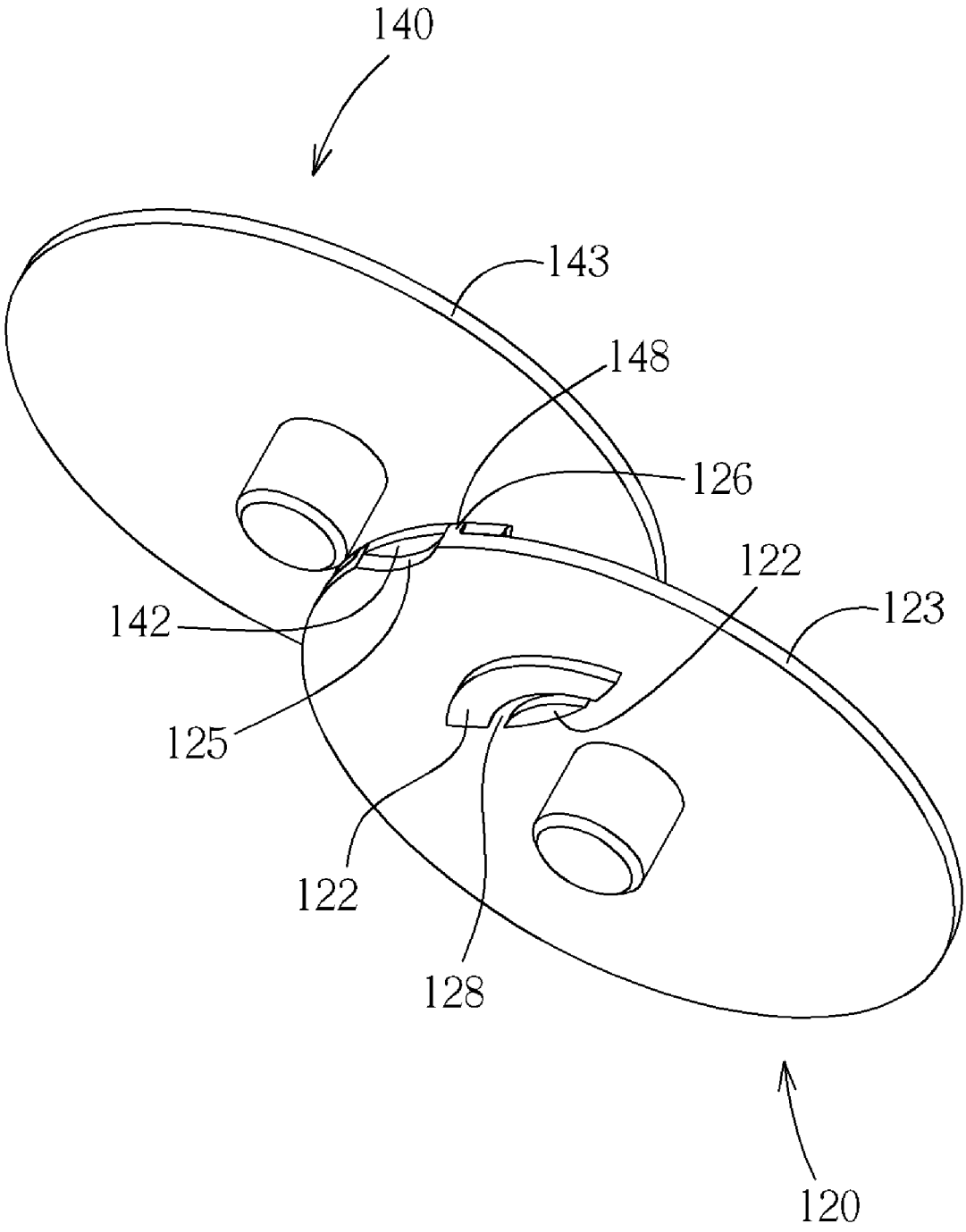
FIG. 7 is a three-dimensional diagram illustrating the first flange and the second flange according to another embodiment of the present invention.
Figure 8:
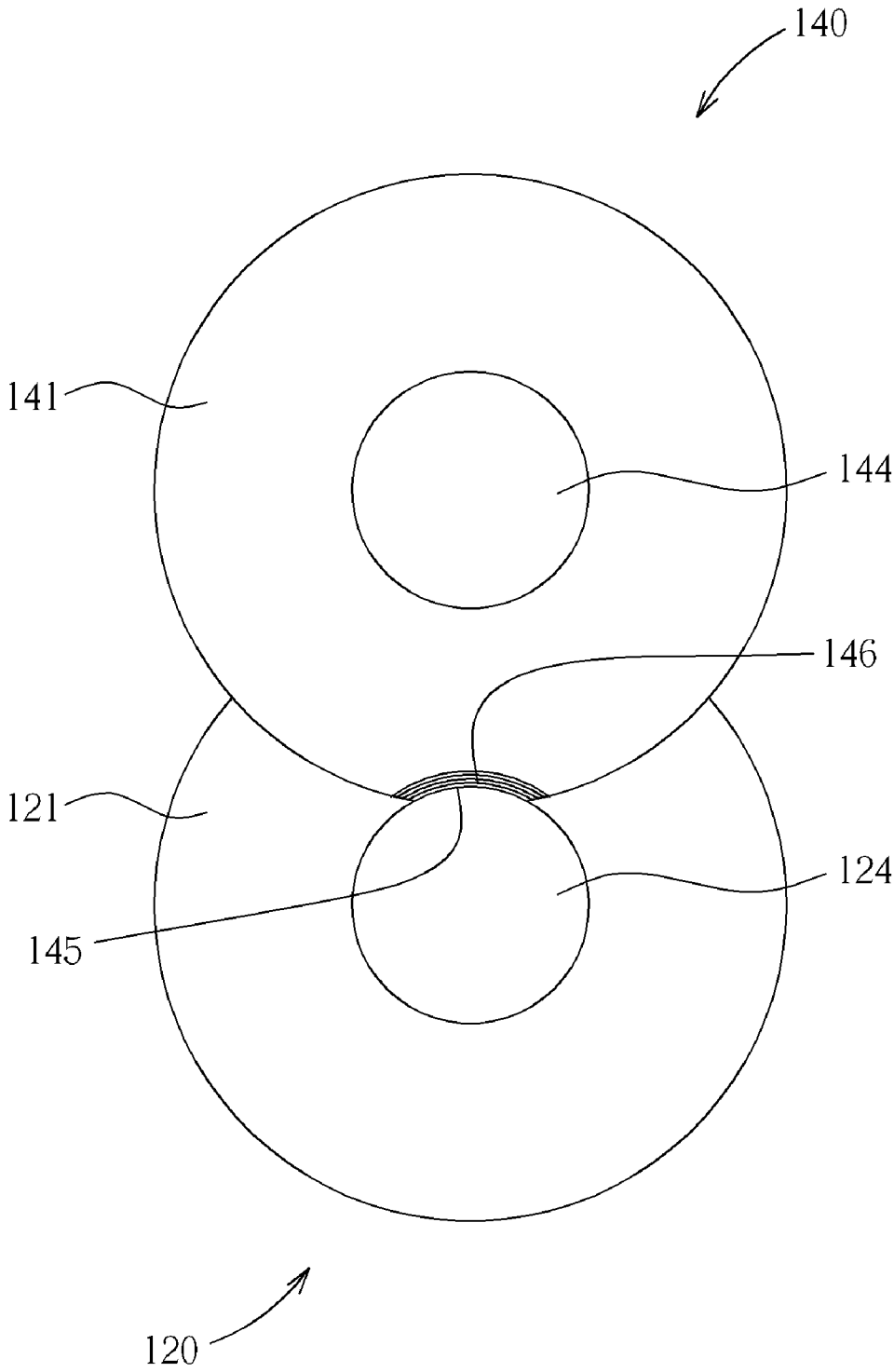
FIG. 8 is a side view diagram illustrating the first flange fastened with the second flange shown in FIG. 6 and FIG. 7.
Figure 9:
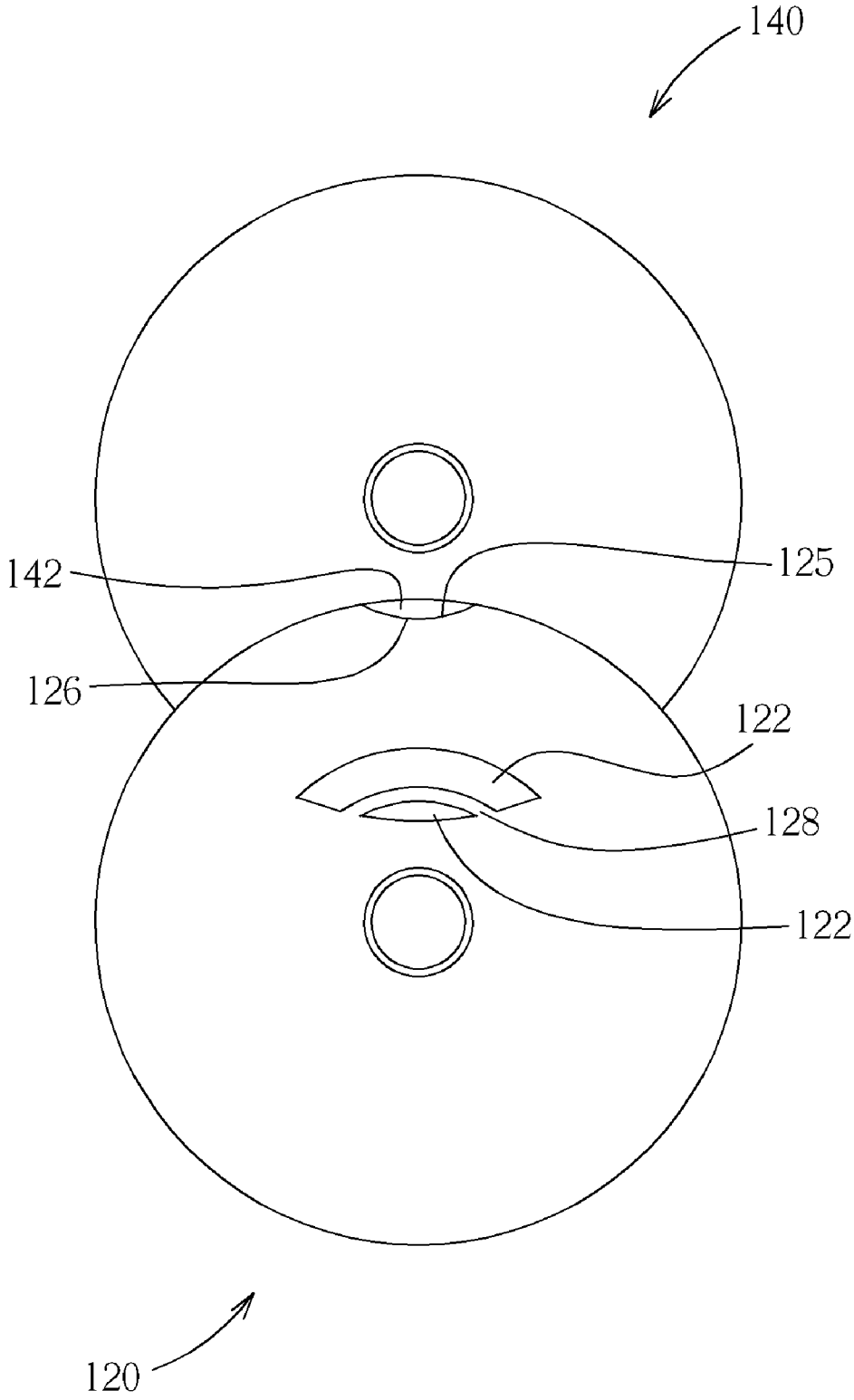
FIG. 9 is another side view diagram illustrating the first flange fastened with the second flange shown in FIG. 6 and FIG. 7.

Please refer to FIG. 6, FIG. 7, FIG. 8, and FIG. 9 FIG. 6 is a plane diagram illustrating the first flange 120 and the second flange 140 according to another embodiment of the present invention. FIG. 7 is a three-dimensional diagram illustrating the first flange 120 and the second flange 140 according to another embodiment of the present invention. FIG. 8 is a side view diagram illustrating the first flange 120 fastened with the second flange 140 shown in FIG. 6 and FIG. 7. FIG. 9 is another side view diagram illustrating the first flange 120 fastened with the second flange 140 shown in FIG. 6 and FIG. 7. In this embodiment, the first flange 120 has a first surface 121, a second surface 122, and a first periphery surface 123. The first surface 121 has a first round protruding part 124. The first periphery surface 123 has a first arc part 125, and the first arc part 125 has a first arc protruding part 126 protruding from the first surface 121. In addition, the second surface 122 of each first flange 120 has a first arc trench part 128. The second flange 140 has a third surface 141, a fourth surface 142, and a second periphery surface 143, wherein the third surface 141 of each second flange 140 has a second round protruding part 144. The second periphery surface 143 has a second arc part 145, and the second arc part 145 has a second arc protruding part 146 protruding from the third surface 141. The second arc part 145 and the second arc protruding part 146 can be utilized for fastening with the first round protruding part 124 on the first surface 121 of the first flange 120. The fourth surface 142 has a second arc trench part 148 for fastened with the first arc protruding part 126 on the first surface 121 of the first flange 120. Similarly, when the first flanges 120 and the second flanges 140 are designed to be the same flanges, the first flanges 120 and the second flanges 140 can be formed by a same mold to reduce production cost.

Briefly summarized, the interlocked roll type apparatus 100 disclosed by the present invention can be applied to a non-cassette package of ribbon of thermal dye-sublimation photo printer, and the interlocked roll type apparatus 100 has advantages of low cost, small volume, convenient to carry, and capable of avoiding rolling.

Those skilled in the art will readily observe that numerous modifications and alterations of the device and method may be made while retaining the teachings of the invention.

What is claimed is:

1. An interlocked roll type apparatus, comprising:

a first spool, for providing a printing medium;

two first flanges, respectively having a first surface, a second surface, and a first periphery surface, the first surface having a first round protruding part, the first periphery surface having at least a first arc part, and the first arc part having a first arc protruding part protruding from the first surface, the two first flanges being respectively disposed on two sides of the first spool, and the first spool being connected to center of the second surface of the two first flanges;

a second spool, for loading the printing medium, wherein a length of the second spool is longer than that of the first spool; and two second flanges, respectively corresponding to the first two flanges and having a third surface, a fourth surface, and a second periphery surface, the second periphery surface having at least a second arc part, and the second arc part having a second arc protruding part protruding from the third surface, the second arc part and the second arc protruding part being fastened with the first round protruding part of the first flange, the fourth surface having a second arc trench part for fastened with the first arc protruding part of the first flange, the two second flanges being respectively disposed on two sides of the second spool, and the second spool being connected to center of the fourth surface of the two second flanges.

2. The interlocked roll type apparatus of claim 1, wherein the second arc trench part is a ring type trench part.

3. The interlocked roll type apparatus of claim 1, wherein the first periphery surface of each first flange has a plurality of first arc parts, each first arc part has a first arc protruding part protruding from the first surface, one of the first arc parts is fastened with the second arc trench part of the corresponding second flange, and there is a predetermined interval between the first arc parts.

4. The interlocked roll type apparatus of claim 1, wherein the second periphery surface of each second flange has a plurality of second arc parts, each second arc part second a first arc protruding part protruding from the third surface, one of the second arc parts is fastened with the first arc trench part of the corresponding first flange, and there is a predetermined interval between the second arc parts.

5. The interlocked roll type apparatus of claim 1, wherein the second surface of each first flange has a first arc trench part.

6. The interlocked roll type apparatus of claim 5, wherein the first arc trench part is a ring type trench part.

7. The interlocked roll type apparatus of claim 1, wherein the third surface of each second flange has a second round protruding part.

8. The interlocked roll type apparatus of claim 1, applied to a non-cassette package of ribbon of thermal dye-sublimation photo printer.

9. The interlocked roll type apparatus of claim 1, wherein the two first flanges and the two second flanges are formed by a same mold.

* * * * *